US005222531A

United States Patent [19]

Baker et al.

[11] Patent Number: 5,222,531

[45] Date of Patent: Jun. 29, 1993

[54] LIQUID CONTAINER SUPPORT AND HYGIENIC LIQUID DISPENSING SYSTEM

[75] Inventors: Henry E. Baker; John B. Baker; David H. Baker, all of Litchfield; Peter K. Baker, Bethlehem, all of Conn.; Edward H. Donselman, Freeport; Ronald C. Katz, Willowbrook, both of Ill.

[73] Assignee: Elkay Manufacturing Company, Oak Brook, Ill.

[21] Appl. No.: 898,570

[22] Filed: Jun. 15, 1992

Related U.S. Application Data

[63] Continuation of Ser. No. 684,642, Apr. 12, 1991, Pat. No. 5,121,778, which is a continuation-in-part of Ser. No. 257,627, Oct. 14, 1988, abandoned.

[51] Int. Cl.[5] ..... B65B 3/04

[52] U.S. Cl. ..... 141/18; 141/21; 141/346; 222/146.6; 222/185

[58] Field of Search ..... 141/18, 21, 82, 319-321, 141/329-332, 324, 346-349, 351-355, 363-366, 383, 386; 222/83.5, 146.6, 185, 541, 545; 215/250, 253, 254, 258, 227; 220/254, 265, 266; 62/389-391; 248/311.3

[56] References Cited

U.S. PATENT DOCUMENTS

| | | | |
|---|---|---|---|
| Re. 12,352 | 5/1905 | Cole | 62/391 |
| Re. 32,354 | 2/1987 | Savage | 141/349 X |
| 497,896 | 5/1893 | Ruppel | 141/349 |
| 996,127 | 6/1911 | Patnaude | 141/363 |
| 1,009,437 | 11/1911 | Patnaude | 222/146.6 X |
| 1,142,210 | 6/1915 | Wagner | 222/185 |
| 1,248,705 | 12/1917 | Pogue | 222/146.6 |
| 1,325,427 | 12/1919 | Weaver | 141/363 |
| 2,057,238 | 10/1936 | Krug | 62/389 X |
| 3,955,682 | 5/1976 | Baren | 248/311.3 |
| 4,239,130 | 12/1980 | Altadonna | 141/332 X |
| 4,391,308 | 7/1983 | Steiner | 141/18 |
| 4,421,146 | 12/1983 | Bond et al. | 141/349 |
| 4,436,125 | 3/1984 | Blenkush | 141/330 |
| 4,597,423 | 7/1986 | Chenot | 141/330 |
| 4,699,188 | 10/1987 | Baker et al. | 141/18 |
| 4,779,426 | 10/1988 | Desrosiers | 222/146.6 X |
| 4,834,267 | 5/1989 | Schroer et al. | 222/185 |
| 4,874,023 | 10/1989 | Ulm | 141/346 |
| 4,991,635 | 2/1991 | Ulm | 141/346 |

FOREIGN PATENT DOCUMENTS

| | | | |
|---|---|---|---|
| 0631376 | 11/1961 | Canada | 222/146.6 |

*Primary Examiner*—Henry J. Recla
*Assistant Examiner*—Casey Jacyna
*Attorney, Agent, or Firm*—Leydig, Voit & Mayer

[57] ABSTRACT

A hygienic liquid dispensing system includes a cap to close the opening of an inverted liquid container enclosing drinking water or other potable liquid. The cap has a lid portion to overlie and sealingly close the opening and an annular skirt portion extending axially away from the lid to surround a portion of the container neck. The lid portion is provided with an axially inwardly extending recess including an outer sleeve and an inner plug portion integrally formed with a frangible connection therebetween. A feed tube is dimensioned for forcible insertion into the recess for breaking the frangible connection and separating the plug portion from the sleeve to permit the discharge of liquid from the container. A mounting apparatus is also provided to fit on the upper portion of a water cooler cabinet and defines an annular ring for supporting the shoulder of an inverted bottle or container thereon. The mounting apparatus also defines a tapered entry portion extending downwardly and inwardly from the annular ring for receiving the neck of the inverted container therein.

10 Claims, 6 Drawing Sheets

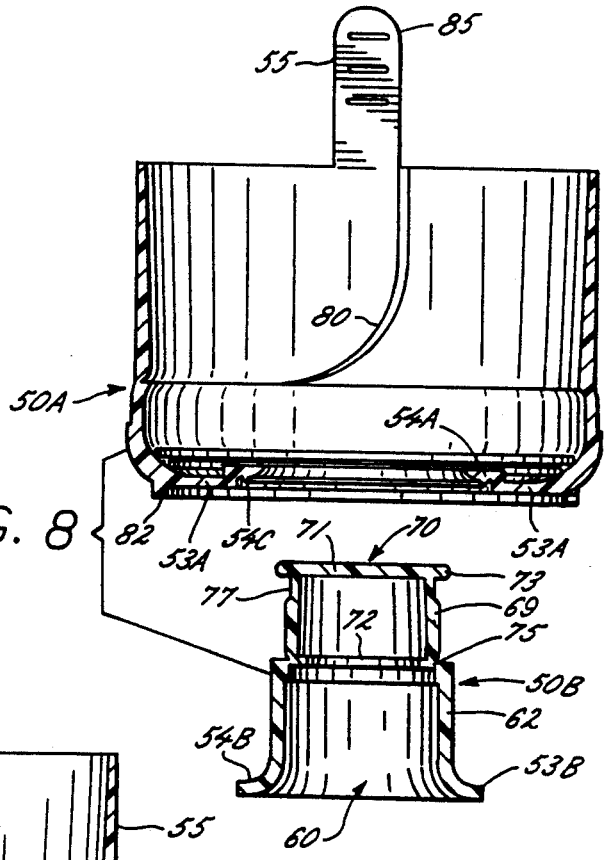
FIG. 8
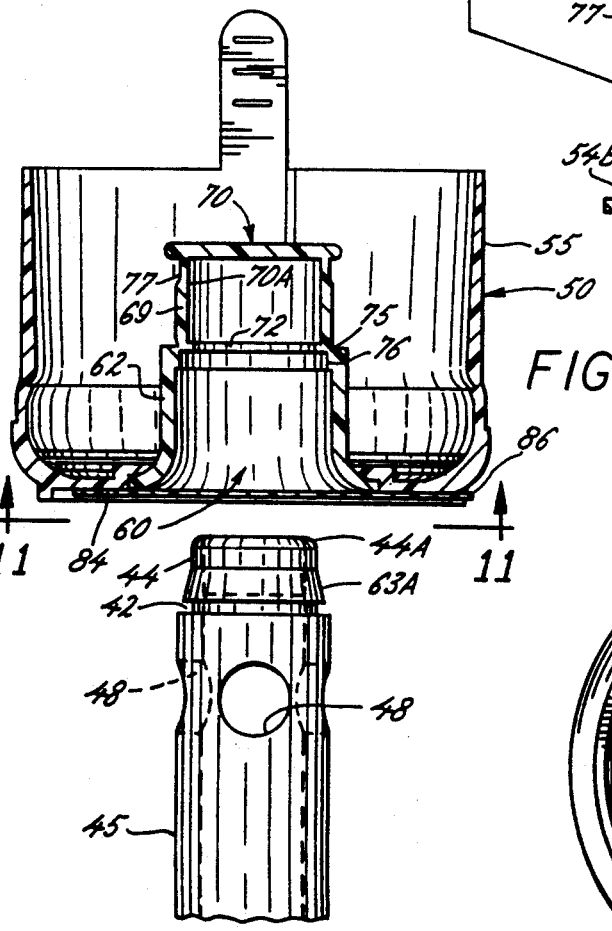
FIG. 9
FIG. 10
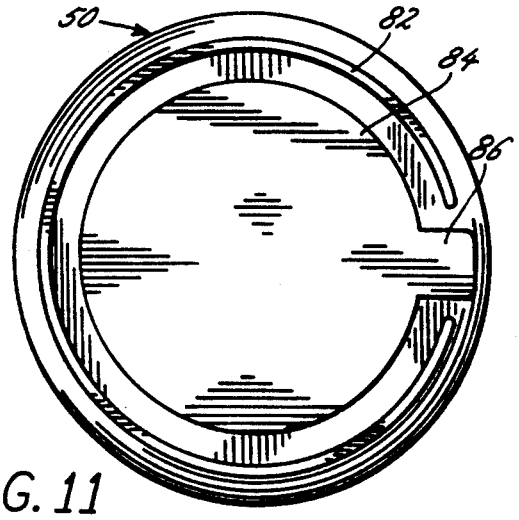
FIG. 11

LIQUID CONTAINER SUPPORT AND HYGIENIC LIQUID DISPENSING SYSTEM

RELATED APPLICATIONS

This is a continuation of copending application(s) Ser. No. 684,642, filed on Apr. 12, 1991 U.S. Pat. No. 5,121,778, which is a continuation-in-part of applicants' copending application Ser. No. 257,627, filed Oct. 14, 1988, now abandoned.

FIELD OF THE INVENTION

The present invention relates generally to liquid dispensers, and more particularly concerns an inverted water bottle container support, hygienic delivery system and a hygienic cap for use in such systems.

BACKGROUND OF THE INVENTION

A cooler and dispenser for bottled water normally has a cooling reservoir within which the inverted neck of a water bottle is disposed. Water flows from the bottle until the water level closes the bottle neck and typically a refrigeration system cools the reservoir and the water being held there. Additionally, some systems are provided with an additional tank, supplied with water from the reservoir, and have a heating system which provides hot water. Water is dispensed by draining the reservoir, usually through a faucet. When the water level falls below the inverted bottle neck, air in the reservoir can enter the bottle, bubble to the top, and release more water to maintain the water level in the reservoir.

Some systems are provided with a cap over the neck of the water bottle so that upon inverting, water is contained until the water bottle is properly inserted into the water cooler. In order to provide fluid communication, these types of water coolers are often provided with a feed tube which pierces the cap upon insertion of the inverted bottle in the cooler and provides a conduit to dispense water into the reservoir. Water coolers of this general type can be found in U.S. Pat. No. 4,699,188 to Baker et al.

It sometimes becomes necessary to replace a partially empty water bottle with a new water bottle containing either the same liquid or a different liquid, or otherwise remove a partially filled water bottle. In conventional systems, however, upon removal, water is discharged through the neck of the water bottle without control. One solution to a similar problem is presented as a resealable plug-type fitting for use with flexible bag containers and is described in U.S. Pat. No. Re. 32,354 to Chester Savage, assignor to Scholle Corporation. An improved hygienic liquid dispensing system for use in water bottle coolers which allows for the removal of a partially filled water bottle is necessary.

OBJECTS AND SUMMARY OF THE INVENTION

It is a primary object of the present invention to provide a hygienic liquid dispensing system which allows for the removal of a partially filled liquid container.

It is a related object of the present invention to provide a system whereby removal of the liquid container causes the liquid to be sealed within the container.

It is a more detailed object of the present invention to provide a cap for a water bottle which, upon inverting the water bottle and inserting the water bottle into a water cooler, allows for the flow of water and upon removal of the water bottle will seal any remaining liquid inside the water bottle.

It is an additional object of the present invention to provide a means for retrofitting existing water cooler systems with a hygienic system.

The above objects are accomplished in accordance with the present invention which provides a liquid container support and hygienic delivery system for dispensing drinking water or other potable liquid from an inverted container having a depending neck defining an opening into a dischargeable reservoir open at its upper end and housed within a cabinet.

A mounting is adapted to fit on the upper portion of the cabinet and defines an annular ring for supporting the inverted container thereon. The mounting means also defines a tapered entry portion extending downwardly and inwardly from the annular ring for receiving the inverted container neck therein. There is also provided a means for sealingly closing the open upper end of the reservoir and for supporting an upstanding feed tube dimensioned to penetrate into the container neck to provide a hygienic flow path for delivering drinking water from the inverted container into the reservoir.

More specifically, a hygienic cap is provided for use with the system having a lid portion adapted to overlie and sealingly close the opening in the bottle neck. Also provided is an annular skirt extending axially away from the lid portion to surround a portion of the bottle neck and an axially inwardly extending recess formed therein including a first annular sleeve portion located generally centrally in the lid portion and integrally connected thereto and a second annular plug portion connected to the inner end of the sleeve portion and extending axially inwardly therefrom. A closed inner end of the plug portion for normally closing the recess is provided and a frangible connection between the plug portion and the sleeve portion is adapted to be broken or ruptured so that the plug portion axially separates from the sleeve portion when forcibly inserting a feed tube into the recess to permit the discharge of liquid from the container. Additionally, there is provided a means for retaining the plug portion on the feed tube so that, upon removal of the feed tube, the plug portion is drawn into the sleeve portion of the cap recess and reseals the liquid in the container.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 8 is an exploded cross-sectional view of a preferred two-piece embodiment of the hygienic cap of the present invention;

FIG. 9 is a composite cross-sectional view of the two-piece cap of FIG. 8, as assembled;

FIG. 10 is an enlarged fragmentary side elevation view of the tip end of a preferred alternative embodiment of the feed tube; and FIG. 11 is an enlarged plan view of the end face of the preferred embodiment of the cap and protective seal covering.

Figure 1:
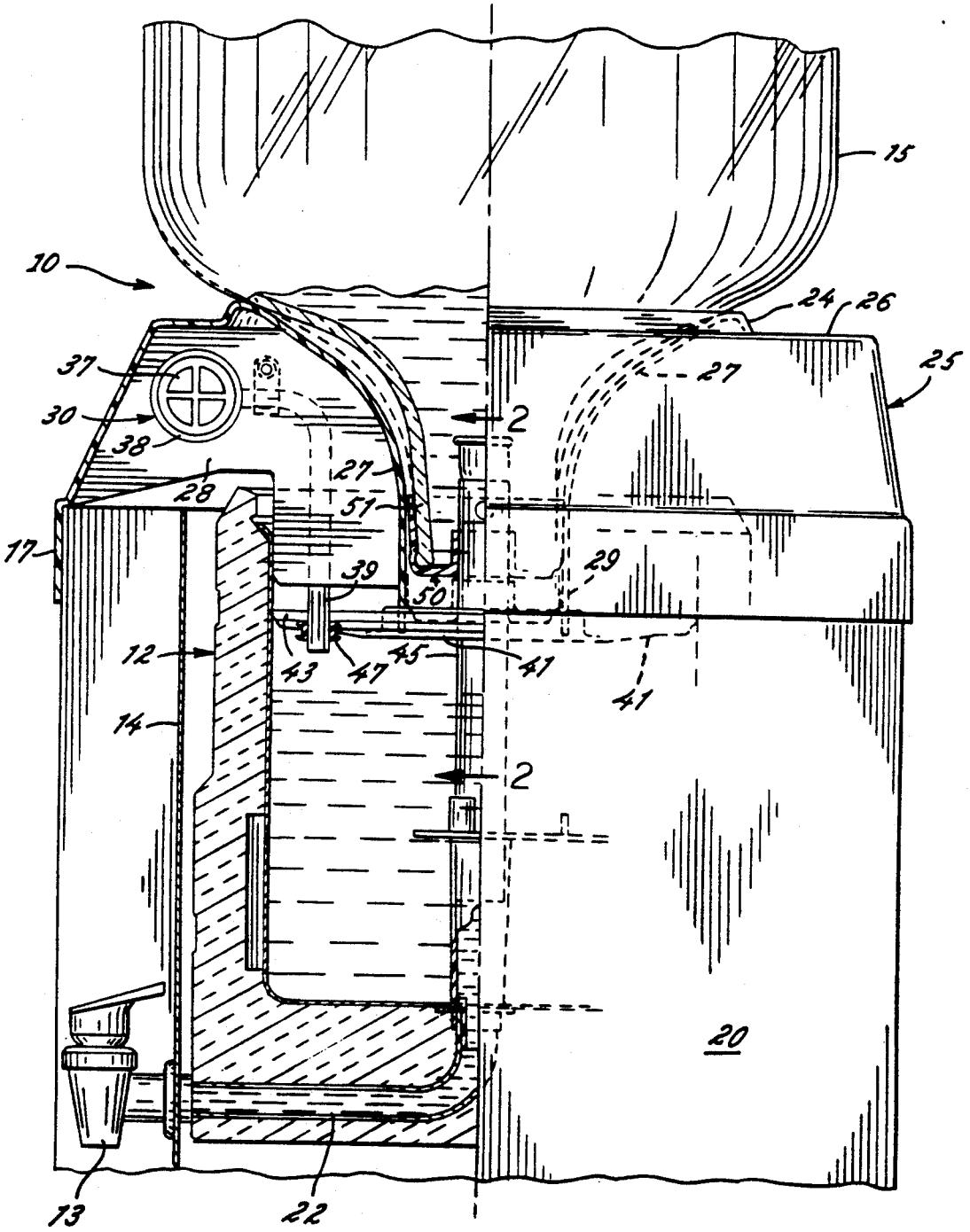
FIG. 1 is a fragmentary side elevation view of the water bottle cooler and hygienic liquid dispensing system including the hygienic cap of the present invention, with certain portions broken away in section.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Turning now to the drawings, there is shown in greater detail, a bottled water cooler 10 including a cabinet 20 of the type having an open-topped cooling reservoir 12 which is disposed to receive the inverted neck of a bottle 15 containing drinking water or other potable liquid. Typically, the reservoir 12 and its contents are subjected to temperature control by a refrigeration system and/or a heating system (not shown) in the lower portion of the cabinet 20, and water is taken from the reservoir through a drain pipe 22 and a faucet 13 mounted on a cabinet front panel 14. In the illustrated cooler 10, the front panel 14 is recessed within the cabinet periphery so as to set the faucet 13 back into the cabinet and thus prevent inadvertent contact.

In keeping with the invention, a mounting adapter 25 is disposed on the upper portion of the water cooler cabinet 20. To properly support the inverted water bottle, the mounting adapter 25 is provided with an annular ring 24 on its upper portion 26 and in order to properly receive and guide the inverted water bottle 15, the mounting adapter 25 is provided with a tapered entry portion 27 extending downwardly and inwardly from the annular ring 24 on the upper portion 26 of the mounting adapter 25. The entry portion 27 is formed with a lower end 29 having a length greater than the container neck 51, so that substantially all of the weight of the inverted water bottle is supported by the annular ring 24 of the mounting adapter 25 rather than by the water bottle neck. In the illustration of FIG. 1, the mounting adapter 25 is provided with downwardly extending side walls 17 and also includes internal stiffening ribs 28 interconnecting the side walls 17, the raised upper portion 26 and the tapered entry portion 27 so as to support the annular ring 24.

As more particularly depicted in FIG. 2, in the illustrated embodiment, an annular diaphragm element 41 coupled to the lower end 29 of the entry portion 27 of the mounting adapter 25 sealingly closes the upper portion of the reservoir 12 and supports an upstanding feed tube 45 whose operation is described in greater detail below.

Figure 3A:
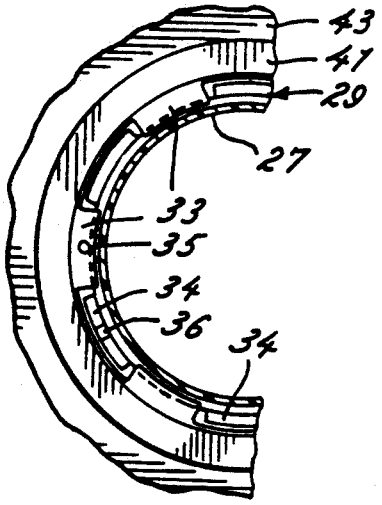
FIGS. 3*a* and 3*b* are fragmentary sections taken substantially along line 3—3 in FIG. 2 showing a detachable connection between an adapter unit of the hygienic liquid dispensing system and an existing water bottle cooler.
Figure 3B:
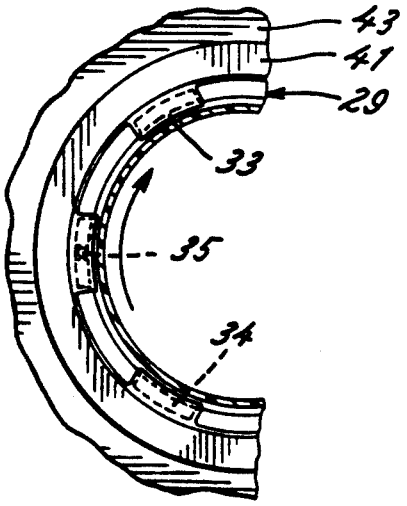

In order that the hygienic liquid dispensing system may be retrofitted to existing water coolers, the diaphragm/feed tube configuration described above carries a flexible peripheral member 43 for sealingly engaging and closing the open end of the reservoir 12. To facilitate the retrofitting between the mounting adapter and an existing water cooler having the diaphragm/feed tube connection, a quick disconnect means is provided having bayonet-type tab fittings 33 on the diaphragm and complementary lugs 34 on the lower end 29 of the entry portion 27 of the mounting adapter 25. As shown in greater detail in FIGS. 3*a* and 3*b*, one or more of the bayonettype tab fittings 33 may be provided with centering detentlike dimples 35 for engagement with complementary recesses 36 formed in the upper surface of the lugs 34 to ensure proper engagement of the quick disconnect means. It will be understood, of course, that other suitable attachment means may be provided, as hereinafter described.

Figure 2:
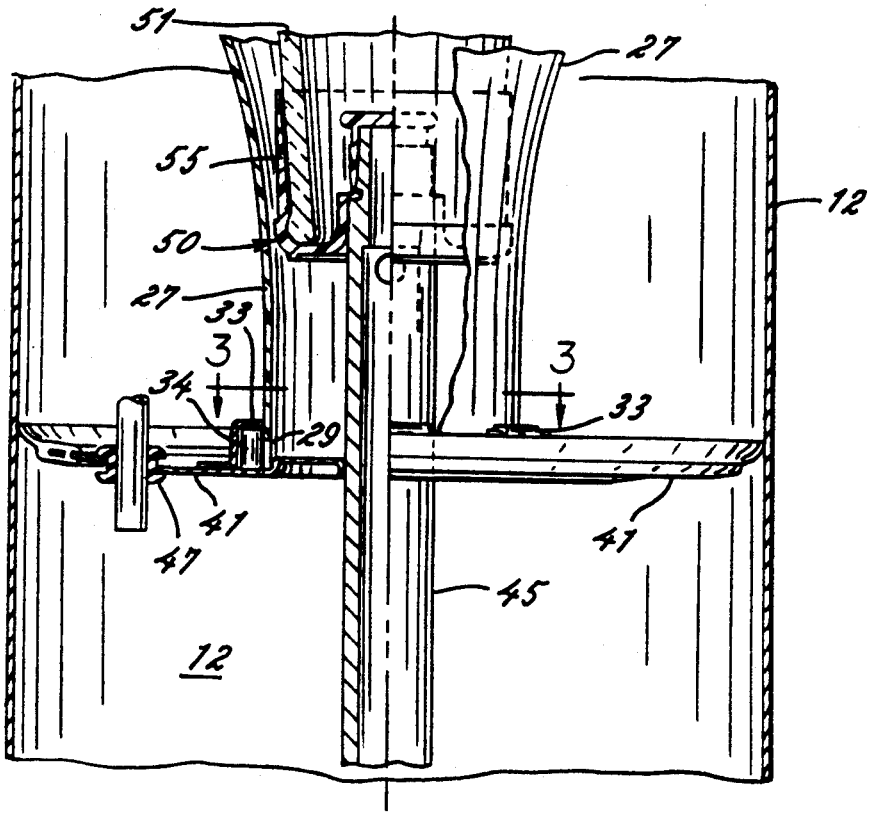
FIG. 2 is a section taken substantially along line 2—2 in FIG. 1 showing the partial insertion of the water bottle in the hygienic liquid dispensing system according to the present invention.

Pursuant to another feature of the invention, and as depicted in FIGS. 1 and 2, an air filter 30 is provided with a filter element 37, having a filter medium removably fitted on the housing 38 of the filter 30. A conduit 39 is connected to the filter housing 38 and passes via a grommet 47, through the diaphragm element 41, so that air cannot enter the reservoir except by passing through the filter medium. A more detailed description of the filter 30 can be found in U.S. Pat. No. 4,834,267, issued May 30, 1989 to Schroer et al. and is hereby incorporated by reference. It will also be appreciated with reference to FIG. 1, that the filter 30 may be conveniently located under the raised upper portion 26 of the mounting adapter 25.

Figures 4A, 4B, 4C:
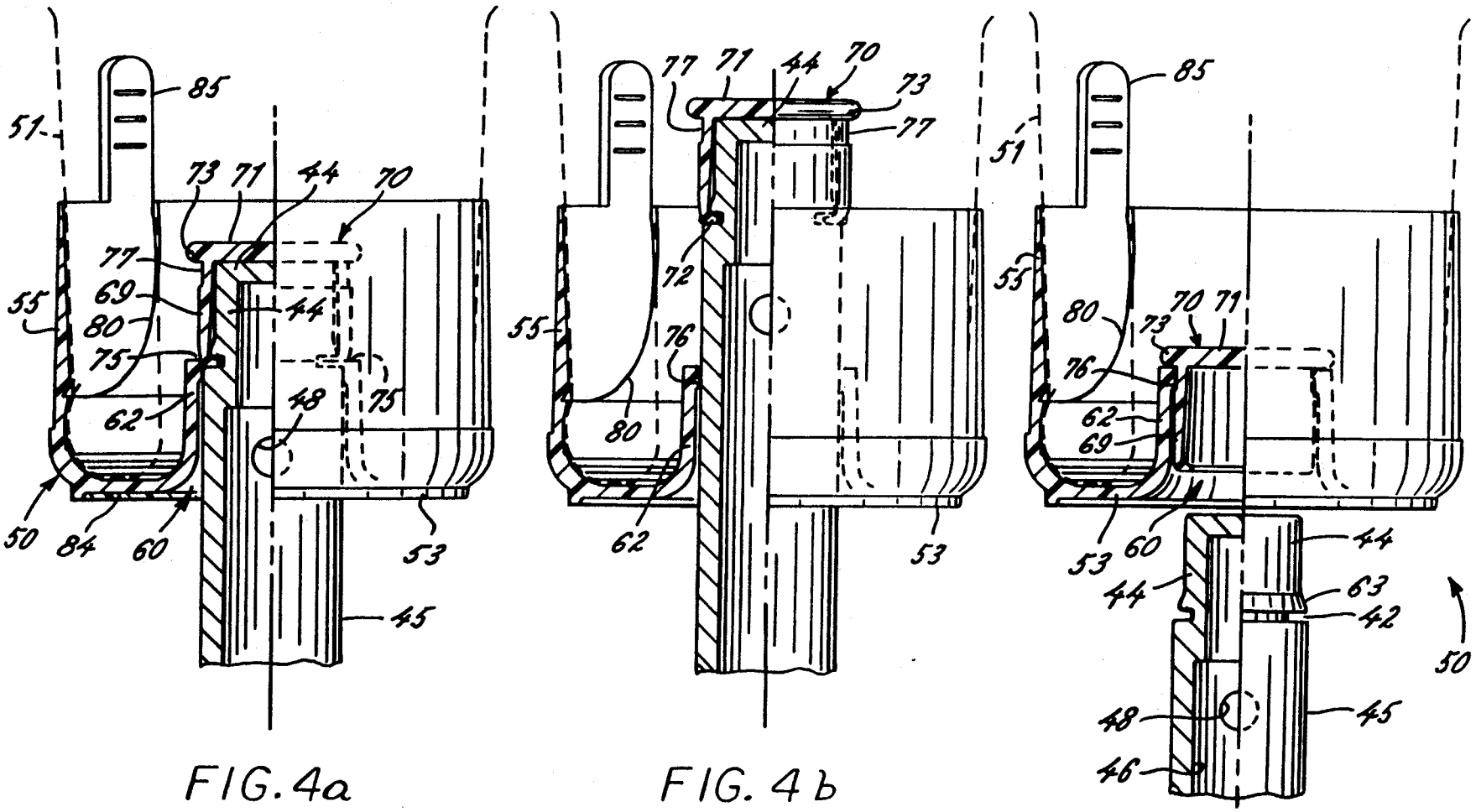
FIGS. 4*a*, 4*b* and 4*c* are enlarged, fragmentary side elevation views, partly in section, showing insertion and removal of the feed tube with respect to the hygienic cap in the hygienic liquid dispensing system according to the present invention.

In keeping with the invention, a hygienic cap 50 for a liquid dispensing system is shown in FIGS. 4*a*, 4*b* and 4*c*. As is conventional with water bottles, a neck portion 51 defines a discharge opening through which liquid may dispense. In order to seal liquid within the bottle, hygienic cap 50 is provided with a lid portion 53 adapted to overlie and sealingly close the discharge opening defined by the neck 51. Additionally, an annular skirt portion 55 of the cap 50 extends axially away from the periphery of the lid portion 53 and is adapted to surround a portion of the neck 51 so as to sealingly retain contact with the neck portion 51 of the water bottle. As will become more apparent below, the hygienic cap 50 is provided with an axially inwardly extending recess 60 formed integrally with or otherwise connected to the lid portion 53. The axially inwardly extending recess 60 includes a first annular sleeve portion 62 which is located generally centrally in the lid portion 53 and is preferably integrally connected thereto.

In keeping with the present invention, a second annular plug portion 70 is connected to the inner end of the first annular sleeve portion 62 and extends axially inwardly therefrom. As shown in the illustrated embodiment, the second annular plug portion 70 is provided with a closed inner end 71 to fully seal liquid within the inverted water bottle.

In keeping with another important aspect of the invention, the second annular plug portion 70 is preferably integral with the first annular sleeve portion 62 and is connected thereto through a frangible connection 75 in order to allow the plug portion 70 to be axially separated from the sleeve portion 62 upon the forcible insertion of a feed tube 45 into the inwardly extending recess 60 to facilitate the discharge of liquid from the inverted water bottle. The frangible connection 75 includes an area of the recess which has reduced wall thickness at the inner end of the sleeve 62 where the plug portion 70 is connected thereto. This single piece construction not only reduces assembly time but also avoids separation and loss of the plug portion. To this end, in the illustrated embodiment, the cap 50 is formed in a single piece. However, and as described below, it will be appreciated that a two-piece construction may sometimes be advantageous. In this regard, the multiple pieces may thereafter be assembled in a one-piece configuration either by spin welding, sonic welding, chemical bonding or the like.

In order to temporarily secure the plug 70 on the feed tube 45 when the feed tube is inserted in the recess 60, the plug portion 70 is formed with an internal gripping rib 72. In a complementary way, so that the feed tube 45 may retain the plug portion 70 upon insertion of the feed tube into the inwardly extending recess 60, feed tube 45 is provided with an annular groove 42 formed in its outside surface. In order to facilitate proper insertion of the feed tube 45 in recess 60, and proper mating engagement between the gripping rib 72 of the plug portion 70 and the annular groove 42 of feed tube 45, feed tube 45 may be provided with an upper tip portion 44 of reduced diameter and a tapered annular ramp portion 63 adjacent the annular groove 42 for guiding the annular gripping rib 72 into the annular groove 42.

Upon further insertion of the feed tube into the recess 60, the frangible connection 75 is broken, thereby allowing the extension of the feed tube 45 into the neck of the inverted water bottle. In a conventional manner, feed tube 45 is formed with an internal bore 46 and at least one radial inlet 48 communicating therewith to allow the dispensing of liquid from the interior of the inverted water bottle to the reservoir 12 as more fully described in the above-mentioned U.S. Pat. No. 4,699,188 to Baker et al. As is apparent and in order to allow fluid flow, the inlet 48 is spaced from the end of the feed tube 45 by a distance that is greater than the internal depth of the plug 70.

As shown in FIG. 4*b*, the exterior surface of the feed tube 45 is dimensioned with respect to the interior of the first annular sleeve portion 62 so that a sealing engagement is effected upon insertion of the feed tube 45 into the recess 60 and the inverted water bottle.

In keeping with another important aspect of the invention, the hygienic liquid dispensing system is provided with means for sealing the inverted water bottle upon removal of the water bottle from the cooler or, conversely, upon removal of the feed tube from the hygienic cap 50. Upon removal of feed tube 45 from the inverted water bottle 15, annular groove 42 retains the annular plug portion 70 of hygienic cap 50 until the plug portion is fully drawn into the axially inwardly extending recess 60 of lid portion 53.

In the embodiment of the hygienic cap 50 illustrated in FIGS. 4*a–c*, the plug portion 70 is formed with an outside annular surface dimensioned to sealingly fit within the sleeve portion 62 when the feed tube 45 is withdrawn from the recess 60. For this purpose, the plug 70 is preferably formed with a tapered lead-in section 69 adjacent the frangible connection 75 for guiding the plug 70 into the sleeve 62 when the feed tube 45 is withdrawn from the recess 60. Adjacent its closed end 71, the plug portion 70 is also preferably provided with an annular flange 73 in order to prevent the plug portion 70 from being removed from the hygienic cap 60. In the illustrated embodiment, the external annular flange 73 is dimensioned to seat on the inner end of the sleeve 62 when the plug 70 is drawn into the sleeve. Additionally, in order to sealingly engage the plug portion 70 with the first annular sleeve portion 62 of the hygienic cap, plug portion 70 is provided with an external annular recess 77 which sealingly cooperates with a radially inwardly projecting bead 76 of sleeve portion 62. Moreover, this external annular groove/internally projecting bed combination provides a gripping means that will allow the feed tube 45 to mate with and retain the plug portion 70 prior to the plug portion becoming slidable disengaged with respect to the sleeve portion 62.

It is another preferred feature of the invention and as illustrated in FIGS. 4*a–c*, that the hygienic cap 50 is also provided with a line of weakness 80 on the skirt 55 extending toward the lid portion 53 and a pull tab 85 extending axially from the skirt. Pull tab 85 is provided to facilitate manually tearing the skirt 55 along the line of weakness 80 when the cap 50 is removed from the container. Additionally, the cap is formed to receive a protective seal 84 covering the recess 60 to prevent contaminants from entering therein. The protective seal 84 also serves to indicate whether the cap has been tampered with prior to insertion of the feed tube 45 into the recess 60.

Figure 5:
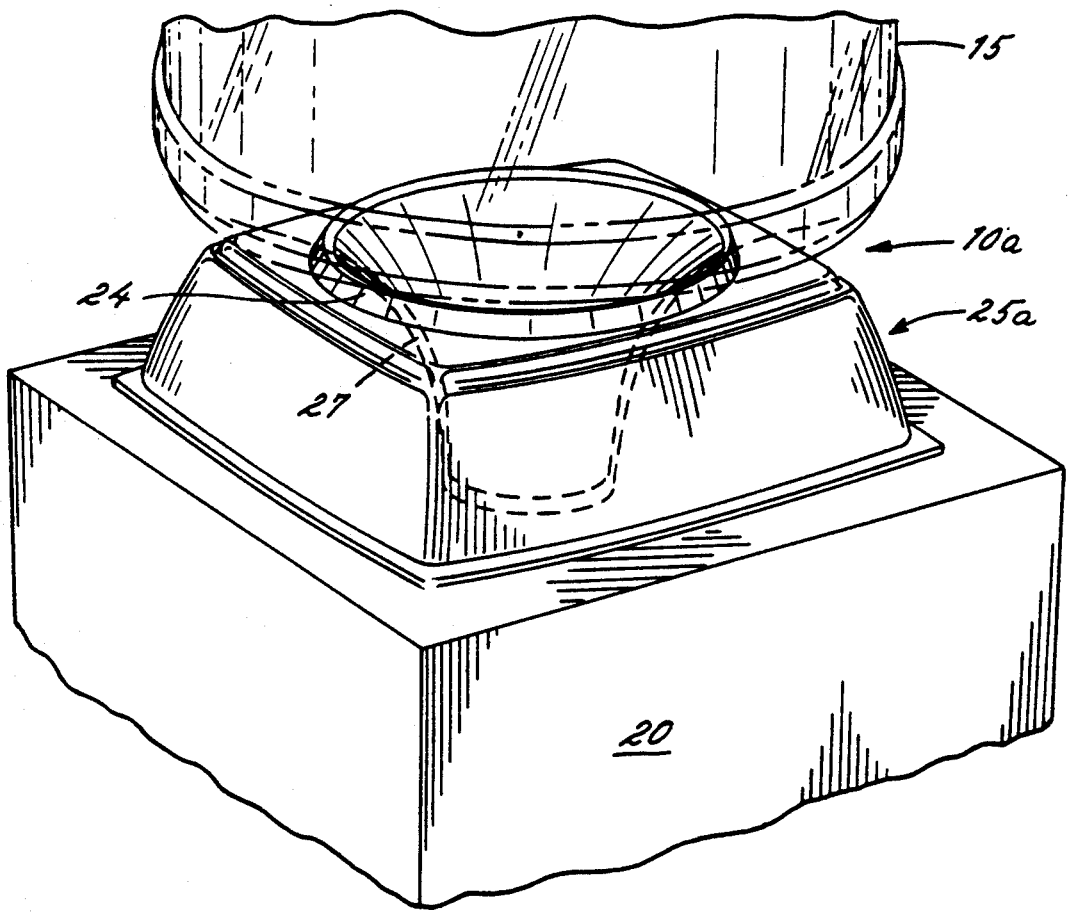
FIG. 5 is a fragmentary perspective view showing an alternative adapter unit having a tapered side wall sitting on top of a water cooler housing.

An alternate embodiment of the invention is illustrated in FIG. 5 wherein the mounting adapter 25*a* is designed to be positioned on top of an existing water cooler 10*a* having a flat upper surface. The above described hygienic water bottle system having the hygienic cap, feed tube and mounting diaphragm is housed within the cooler 10*a*, but is not shown here.

Figure 6:
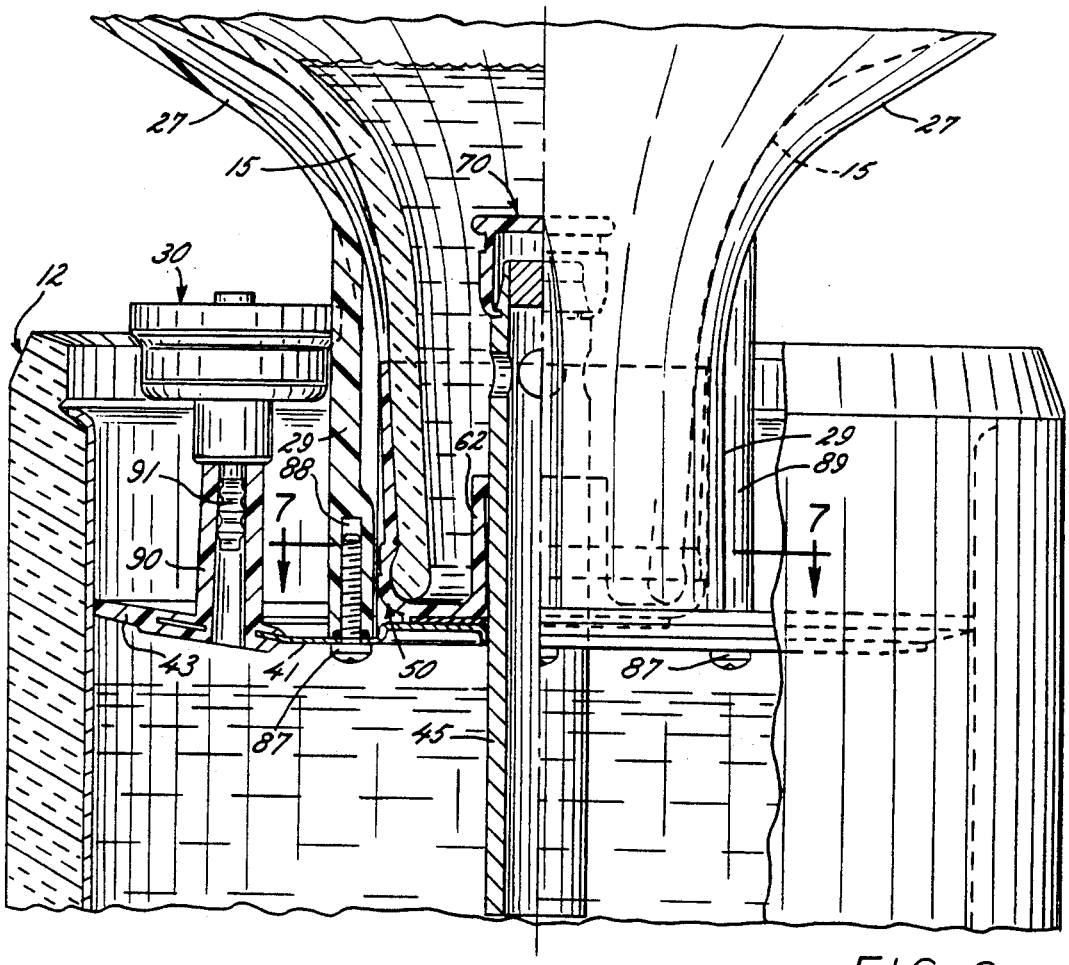
FIG. 6 is an enlarged fragmentary side elevation view of a preferred alternative embodiment of the water bottle cooler and hygienic liquid dispensing system including the hygienic cap of the present invention, with certain portions broken away in section, similar to FIG. 1.
Figure 7:
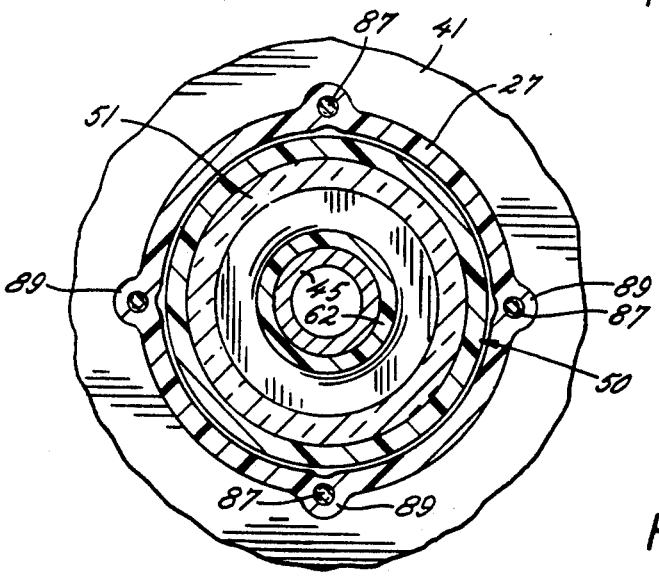
FIG. 7 is a fragmentary section taken substantially along line 7—7 in FIG. 6.

A further alternative and preferred embodiment of the invention is illustrated in FIG. 6 wherein the diaphragm element 41 is detachably secured to the lower end 29 of the entry portion 27 of the mounting adapter 25 by means of a plurality of cap screws or other suitable threaded connectors 87. As shown here and in FIG, 7, four screws 87 are threadably received in recesses 88 located in vertically extending reinforcing ribs 89 formed on the lower end 29 of the mounting adapter 25. Also, in this preferred embodiment, the flexible peripheral sealing member 43 of the diaphragm is formed with an integral upwardly extending tube 90 for receiving the connecting nipple 91 of the air filter unit 30.

As previously mentioned herein, the hygienic cap 50 of the present invention may be made of a two-piece construction, if desired. Thus, as shown in FIG. 8, cap 50 comprises two parts: the outer shell 50A including the annular skirt portion 55 and the outer annular portion 53A of the lid; and the inner insert portion 50B including the annular plug portion 70, the annular sleeve portion 62, and an annular flange portion 53B which joins the annular portion 53A to complete the lid portion 53 of the assembled cap 50 when the two parts 50A and 50B are joined together. While various bonding techniques may be employed such as spin welding, adhesive or chemical bonding, to secure the parts 50A and 50B together, sonic welding is preferred. In this connection, the shell 50A includes an axially inwardly disposed annular ledge 54A against which the inner face 54B of the flange 53B of the insert portion 50B is pressed. Desirably, the inner periphery of the ledge 54A is radiused to mate smoothly with the curvature of the flange 53B where it merges into the outer wall surface of the sleeve portion 62 and the flange 53B includes a raised annular rib 54C which is flattened and sealed against the flange during the sonic welding process. A completed hygienic cap 50 with the two pieces 50A and 50B assembled and bonded together is shown in FIG. 9.

An alternative and preferred embodiment of the feed tube 45 is shown in FIG. 10. As shown here the tip end 44 of the feed tube 45 is provided with a somewhat more rounded or radiused end portion 44A to facilitate easy entrance past the gripping rib 72 and into the inner bore 70A of the plug portion 70. The preferred embodiment of the feed tube 45 also includes four radial openings 48 spaced axially outwardly from the annular groove 42 in which the gripping rib 72 seats upon insertion of the feed tube 45 into the plug 70. It will also be seen that the tapered annular ramp portion 63A of this preferred embodiment is somewhat longer and more gradually inclined outwardly than the ramp 63 of the feed tube 45 shown in FIGS. *4a–4c*.

An end view of the preferred embodiment of the hygienic cap 50 is shown in FIG. 11 with the protective seal 84 in place covering the outer open end of the recess 60. It will be understood that this protective seal 84, which prevents dirt and other contaminants from entering the recess 60 during storage and transportation of the bottle or container 15, is removed from the cap 50 just prior to inverting the bottle 15 and installing it in the bottle water cooler 10. To this end the seal 84 is generally disc-shaped but, desirably, includes a radially extending pull tab 85 to facilitate easy gripping when the seal is pulled from the cap.

It will also be understood that the protective seal 84 is secured to the cap 50 by a suitable adhesive that secures the seal 84 firmly in place during storage and transportation but releases readily when the tab 86 is pulled. The seal may be made of treated paper, foil, plastic film or a suitable laminate thereof and, if desired, may be imprinted with an appropriate brand name, company logo, product designation, bar coding or the like. In the illustrated embodiment, the end face of the hygienic cap 50 is also provided with a substantially continuous circumferential bead 82 which defines a recessed area for the protective seal 84 and helps prevent it from being accidentally scraped off.

We claim as our invention:

1. A liquid container support and hygienic delivery system for dispensing drinking water or other potable liquid to a predetermined maximum liquid level in a dischargeable reservoir open at its upper end and housed within a cabinet from an inverted unpressurized container having an internal liquid confining surface defined by a substantially rigid, generally cylindrical body with a radially inwardly directed downwardly sloping shoulder portion merging into a generally cylindrical depending neck defining an opening closed by a coaxial cap circumferentially surrounding at least an outer axial portion of said neck and having an internal recess therein including a hollow tubular sleeve portion and a sealing plug portion defining a closed end with a central cavity having internal gripping means therein connected thereto, comprising, in combination, removable mounting means adapted to fit on the upper portion of said cabinet and defining an annular ring for supporting said sloping shoulder portion of said inverted container thereon, said removable mounting means also defining a tapered entry portion having a substantially closed inner wall extending downwardly and inwardly from said annular ring for receiving said depending container neck and said coaxial cap therein, said entry portion having a substantially closed bottom end and a length greater than that of said depending container neck and said coaxial cap when said inverted container shoulder portion is supported on said annular ring, sealing means carried by said removable mounting means for sealingly closing said open upper end of said reservoir, an upstanding feed tube dimensioned to penetrate into said hollow tubular sleeve portion of said coaxial cap and said container neck to provide a hygienic flow path for delivering liquid from said inverted unpressurized container into said reservoir to said predetermined maximum liquid level and for admitting air from said reservoir above said liquid level into said container to displace the liquid delivered therefrom, said feed tube having upper and lower end portions, means carried by said removable mounting means for rigidly supporting said upstanding feed tube with said upper end projecting upwardly from said bottom end of said entry portion and said lower end depending downwardly from said bottom end of said entry portion of said removable mounting means into said reservoir to define said predetermined maximum liquid level, said upper end of said feed tube having a length greater than said recess in said coaxial cap and being disposed and adapted for entry into said recess to axially separate said cap plug portion from said hollow tubular sleeve portion when said container is inverted and lowered onto said mounting means with said sloping shoulder portion of said inverted container supported by said annular ring in order to permit the discharge of liquid from said container into said reservoir to said predetermined maximum liquid level and admission of air from said reservoir above said liquid and into said container, and said upstanding feed tube being disposed and dimensioned to hold said cap plug portion free of contact with said hollow tubular sleeve portion of said coaxial cap and said internal liquid confining surface of said inverted container when said sloping shoulder portion is supported on said annular ring of said mounting means.

2. A system as defined in claim 1 wherein said feed tube includes an internal bore and a radial inlet communicating therewith, said inlet being spaced from the tip end of said feed tube by a distance greater than the internal depth of said internal cavity of said plug portion of said coaxial cap.

3. A system as defined in claim 1 wherein said upper end of said feed tube is formed with complementary external gripping means for securing said plug on said feed tube when said feed tube is inserted in said recess of said coaxial cap and said plug portion is axially separated from said hollow tubular sleeve portion.

4. A system as defined in claim 3 wherein said internal gripping means includes a radially inwardly projecting annular lip formed in said plug cavity and said external gripping means includes an annular groove formed in said tip portion of said upper end of said feed tube.

5. A system as defined in claim 1 wherein said plug portion is dimensioned to sealingly interfit with said hollow tubular sleeve portion when said inverted container is lifted off said support ring and said feed tube is withdrawn from said recess of said coaxial cap.

6. A system as defined in claim 1 wherein said removable mounting means includes a downwardly extending outer side wall adapted to engage said cabinet and internal ribs interconnecting said outer side wall and said downwardly and inwardly extending closed inner wall of said tapered entry portion.

7. A liquid container support and hygienic delivery system for dispensing drinking water or other potable liquid to a predetermined maximum liquid level in a dischargeable reservoir open at its upper end and housed within a cabinet from an inverted unpressurized container having a substantially rigid body with a radially inwardly directed downwardly sloping shoulder portion merging into a generally cylindrical depending neck defining an opening closed by a coaxial cap circumferentially surrounding at least an axial outer portion of said neck and having an internal recess therein including a hollow tubular sleeve portion and a sealing plug portion defining a closed end with a central cavity having internal gripping means therein connected thereto, comprising, in combination, removable mounting means adapted to fit on the upper portion of said cabinet and defining an annular ring for supporting said sloping shoulder portion of said inverted container thereon, said removable mounting means also defining a tapered entry portion extending downwardly and inwardly from said annular ring for receiving said depending container neck and said coaxial cap therein, said entry portion having a substantially closed bottom end and a length greater than that of said depending container neck and said coaxial cap when said inverted container shoulder portion is supported on said annular ring, an elongated feed tube having a tip end, a substantially hollow tubular body portion and a base portion including support means for orienting said feed tube substantially vertically in said tapered entry portion with said tip end pointed upwardly for admitting air into and dispensing drinking water or other potable liquid from within said inverted substantially rigid unpressurized container, said feed tube body portion being dimensioned for close fitting sealing relation with the inside diameter of said internal cap recess to prevent leakage therebetween when said feed tube is inserted into and through said recess, said hollow feed tube having an internal bore and at least one radial opening communicating therewith, said radial opening being spaced from said tip end of said feed tube by a distance that is greater than the internal depth of said plug cavity, said radial opening and said bore defining fluid passage means for dispensing liquid from said container into said reservoir up to said predetermined liquid level and for admitting air from said reservoir above said liquid level into said container to displace said dispensed liquid and said fluid passage means being unobstructed by internally or externally disposed valving to permit the free flow of liquid and air therethrough.

8. A liquid container support and hygienic liquid dispensing system as defined in claim 7 wherein said feed tube tip end has a reduced cross sectional diameter for insertion into said plug cavity and said tip end has complementary external gripping means for cooperating with said internal gripping means in said plug cavity for securing said plug on said feed tube tip when said feed tube is inserted into and through said internal recess of said coaxial cap.

9. A liquid container support and hygienic liquid dispensing system as defined in claim 8 wherein said internal gripping means includes a radially inwardly projecting annular lip formed in said plug cavity and said external gripping means includes an annular groove formed in the tip portion of said feed tube.

10. A liquid container support and hygienic liquid dispensing system as defined in claim 9 wherein said feed tube tip is formed with a tapered annular ramp portion adjacent said groove for guiding said inwardly projecting annular lip in said plug cavity into said annular groove.

* * * * *